US011903473B2

(12) United States Patent
Yin et al.

(10) Patent No.: US 11,903,473 B2
(45) Date of Patent: Feb. 20, 2024

(54) HAIR-STRAIGHTENING COMB FOR QUICK STYLING

(71) Applicant: Guangdong Hongyuan Electric Appliance Co., Ltd, Dongguan (CN)

(72) Inventors: Taiqiao Yin, Luzhou (CN); Shengquan Wang, Shangrao (CN); Yu Xian, Dongguan (CN)

(73) Assignee: GUANGDONG HONGYUAN ELECTRIC APPLIANCE CO., LTD, Dongguan (CN)

( * ) Notice: Subject to any disclaimer, the term of this patent is extended or adjusted under 35 U.S.C. 154(b) by 301 days.

(21) Appl. No.: 17/478,785

(22) Filed: Sep. 17, 2021

(65) Prior Publication Data

US 2023/0020204 A1 Jan. 19, 2023

(30) Foreign Application Priority Data

Jul. 19, 2021 (CN) ..... 202121648316.3

(51) Int. Cl.
*A45D 2/00* (2006.01)
*A45D 20/48* (2006.01)

(52) U.S. Cl.
CPC ..... *A45D 2/002* (2013.01); *A45D 20/48* (2013.01)

(58) Field of Classification Search
CPC ..... A45D 24/00; A45D 24/007; A45D 24/02; A45D 24/04; A45D 24/06; A45D 24/10; A45D 24/12; A45D 24/16; A45D 24/18; A45D 24/22; A45D 24/26; A45D 24/28; A45D 24/30; A45D 24/32; A45D 24/34; A45D 24/42; A45D 24/44; A45D 1/00; A45D 1/02; A45D 1/04; A45D 1/18; A45D 1/28; A45D 2001/002; A45D 2001/004; A45D 2001/008; A45D 2001/045; A45D 20/12; A45D 20/48; A45D 20/50; A45D 20/52; A45D 2200/15; A45D 2200/155; A46B 2200/104; A46B 15/00; A46B 15/003; A46B 15/0022; A46B 15/0051; A46B 15/0059; A46B 9/00; A46B 9/02; A46B 9/023; A46B 9/26; A46B 7/00
See application file for complete search history.

(56) References Cited

U.S. PATENT DOCUMENTS

2015/0122286 A1* 5/2015 Valle ..... A45D 2/002 132/229
2018/0125223 A1* 5/2018 Exley ..... A45D 2/002

* cited by examiner

*Primary Examiner* — Cris L. Rodriguez
*Assistant Examiner* — Karim Asqiriba
(74) *Attorney, Agent, or Firm* — Seed IP Law Group LLP

(57) ABSTRACT

Disclosed is a hair-straightening comb for quick styling, which includes a comb-tooth part and a handle part, the comb-tooth part includes a housing with an inner cavity, a heat-conducting comb body sealingly embedded in the inner cavity, and a heat-generating component fixed on a back side of the comb body; the comb body includes a bottom plate and short comb teeth formed on an outer surface of the bottom plate, and the bottom plate has a plurality of embedding grooves distributed at intervals, a comb-tooth bar is embedded in the embedding groove; the handle part includes an outer casing, and a fan component and an air inlet provided on the outer casing, an air duct communicating with the outer casing is formed between the housing and the comb body, and air outlet holes communicate with the air duct.

8 Claims, 4 Drawing Sheets

HAIR-STRAIGHTENING COMB FOR QUICK STYLING

BACKGROUND

Technical Field

The present disclosure relates to the technical field of hairdressing equipment, and more particularly, to a hair-straightening comb for quick styling.

Description of the Related Art

A hair-straightening comb is a hairdressing tool, which usually includes a handle part and a comb-tooth part, the comb-tooth part has heat-conducting comb teeth, such as metal or ceramic comb teeth. The comb teeth are heated by the heat-generating element and then the hair is combed, so that the hair is softened and deformed, and the purpose of hair straightening is achieved after cooling. In an existing common hair-straightening comb structure, the comb body of the comb-tooth part is made of metal or ceramic heat-conducting material, in order to prevent users from being scalded by the heat-conducting comb teeth, heat-insulating teeth are usually added to the top of the heat-conducting comb teeth. For hair-straightening combs with this structure, if the comb teeth are sparse, the hair gripping effect is poor, and if the comb teeth are dense, the weight of the hair-straightening comb is heavy and thus inconvenient to use; in addition, after the hair is heated by the hair-straightening comb, it takes a period of natural cooling before the hair can be styled, which makes the hair-straightening operation time longer.

BRIEF SUMMARY

The purpose of the present disclosure is to provide a hair-straightening comb that is convenient to use and can style the hair quickly.

In order to achieve the above purpose, the technical solutions adopted by the present disclosure are as follows:

A hair-straightening comb for quick styling, which includes a comb-tooth part and a handle part, the comb-tooth part includes a housing with an inner cavity, a heat-conducting comb body sealingly embedded in the inner cavity, and a heat-generating component fixed on a back side of the comb body; the comb body includes a bottom plate and short comb teeth formed on an outer surface of the bottom plate, and the bottom plate has a plurality of embedding grooves distributed at intervals, a comb-tooth bar is embedded in the embedding groove, and the comb-tooth bar has long comb teeth protruding from the bottom plate and higher than the short comb teeth; the handle part includes an outer casing, and a fan component, and an air inlet provided on the outer casing, an air duct communicating with the outer casing is formed between the housing and the comb body, and two side edges of the housing are provided with air outlet holes communicating with the air duct and facing the comb teeth.

Some beneficial effects of the above solution are: air outlets are provided on both sides of the housing, and the hair can be quickly cooled and styled by cold air after being heated and deformed by the comb body, thereby shortening the hair-straightening operation time; the comb-tooth bar is embedded in the embedding groove of the comb body, in addition, the structure with long comb teeth higher than short comb teeth can prevent a user from being scalded through long comb teeth, and thereby significantly reducing the weight of the comb body, making the operation more convenient. At the same time, it can maintain the density of the comb teeth, thereby achieving a better grasping and styling effect.

According to one solution, one or more comb-tooth bars are arranged in the middle of the bottom plate along the axial direction of the hair-straightening comb, and an elastic support bar is provided below the comb-tooth bars to make the comb-tooth bars movable.

In the above solution, the elastic support bar makes the comb teeth located in the middle of the comb teeth movable and can better fit the surface of the scalp, thereby grabbing the roots of the hair, achieving a better styling effect, and increasing the comfort during use.

According to one solution, the heat-generating component includes a heat-conducting plate fixed on a bottom surface of the bottom plate, and a PTC heat-generating element and an NTC temperature sensor fixed on the heat-conducting plate; wherein the heat-conducting plate is configured to restrict the comb-tooth bar in the embedding groove from the bottom surface.

In the above solution, the heat-conducting plate can not only conduct heat evenly to the comb body, but also be used to fix the comb-tooth bar, thereby making the structure compact and easy to install; the PTC heat-generating element is energy-saving and safe, and the NTC temperature sensor can ensure stable and controllable temperature.

According to one solution, the air outlet hole is inclined toward both outer sides of the comb-tooth part.

In the above solution, the air outlet hole is inclined toward the outside, thereby preventing the cold air from approaching the comb body, which will affect the cooling effect of the cold air and the heating effect of the comb body.

According to one solution, a heat insulation plate is arranged between the housing and the comb body.

In the above solution, the heat insulation plate can prevent the heat of the comb body and the heating component from being transferred to the back of the housing, and at the same time can prevent the cold air flowing through the air duct from being heated.

According to one solution, two side edges of the heat insulation plate are provided with vertically arranged splitter plates, and the splitter plates and an inner wall of the housing form the air duct communicating with the air outlet hole.

In the above solution, the cold air is fed in from the outer casing and blown out from the air outlet holes through the air ducts on both sides, thereby the air being concentrated, and the cooling effect being better.

According to one solution, a comb-tooth surface of the comb-tooth part is a concave arc surface.

In the above solution, the concave arc surface enables the entire comb tooth surface of the comb tooth part to better fit the surface of the scalp and achieve a better hair grasping effect.

According to one solution, a control circuit board is arranged in the outer casing of the handle part, and corresponding control buttons are arranged on the outer casing.

In the above solution, the control circuit board and the control buttons are arranged on the handle part, thereby being compact in structure and more convenient to operate.

BRIEF DESCRIPTION OF THE SEVERAL VIEWS OF THE DRAWINGS

The present disclosure will be further described in detail below with reference to the drawings and specific embodiments.

DETAILED DESCRIPTION

Figure 1:
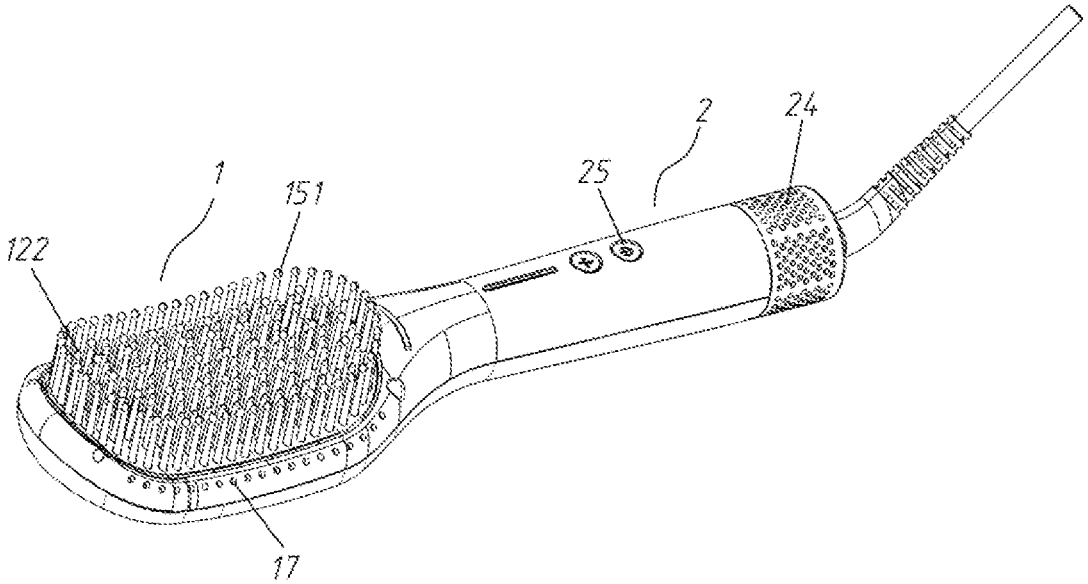
FIG. 1 is a schematic diagram of an overall structure of the hair-straightening comb according to an embodiment.
Figure 2:
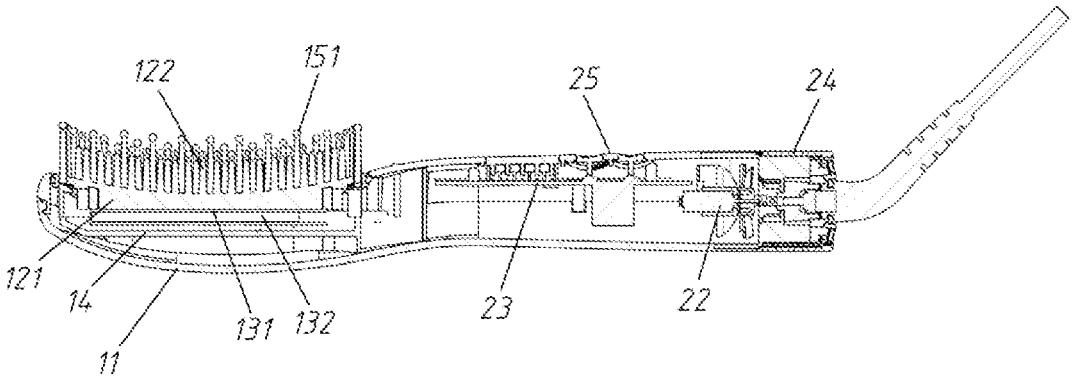
FIG. 2 is an axial cross-sectional structural diagram of the hair-straightening comb in FIG. 1.
Figure 3:
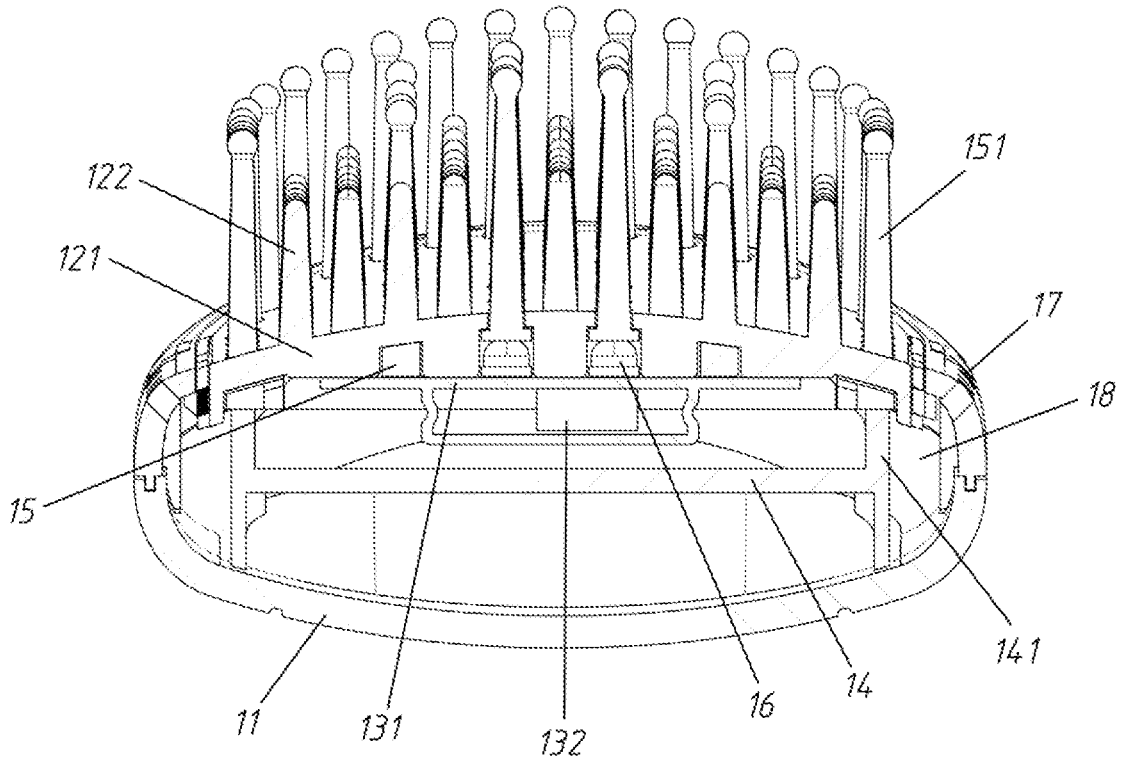
FIG. 3 is a transverse cross-sectional structural diagram of the hair-straightening comb in FIG. 1.
Figure 4:
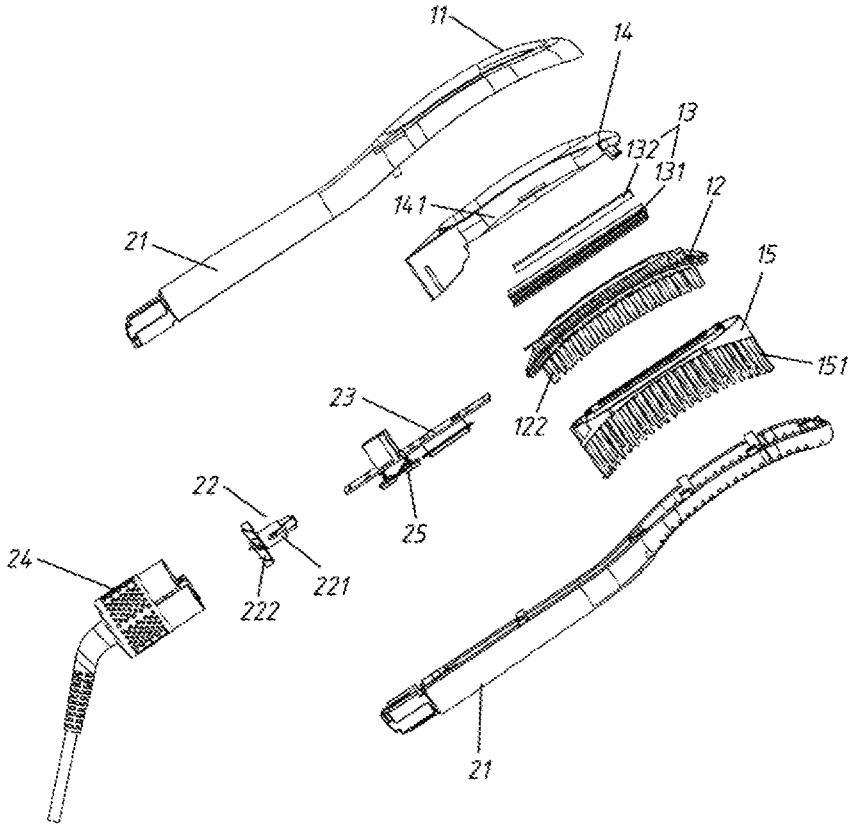
FIG. 4 is an exploded structural diagram of the parts of the hair-straightening comb in FIG. 1.
Figure 5:
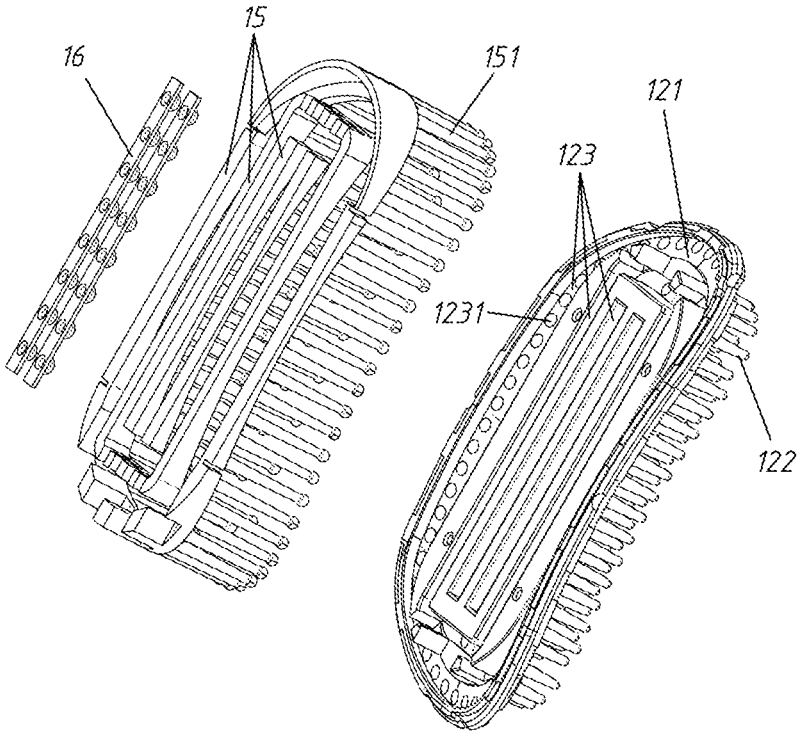
FIG. 5 is an exploded structural diagram of the parts of the comb-tooth part of the hair-straightening comb in FIG. 1.

The present disclosure will be further described below in conjunction with the accompanying drawings:

Referring to FIGS. 1 to 5, a hair-straightening comb for quick styling includes a comb-tooth part 1 and a handle part 2, and comb teeth are distributed on the top surface of the comb-tooth part 1.

The comb-tooth portion 1 includes a housing 11 with an inner cavity, a heat-conducting comb body 12 sealingly embedded in the inner cavity, and a heat-generating component 13 fixed on the back of the comb body 12. In an advantageous structure, a heat insulation plate 14 is arranged between the housing 11 and the comb body 12. The heat insulation plate 14 can prevent the heat of the comb body 12 and the heating element 13 from being conducted to the back of the housing 11. The edge profile of the comb body 12 matches the shape of the side wall of the inner cavity, and they are sealed and fixed to each other. The comb body 12 includes an aluminum bottom plate 121 integrally formed by die-casting and short comb teeth 122 located on the outer surface of the bottom plate 121, the bottom plate 121 has a plurality of embedding grooves 123 distributed at intervals, and through holes 1231 are provided on the top surface of the embedding groove 123, a comb-tooth bar 15 is embedded in the embedding groove 123, and the comb-tooth bar 15 has long comb-teeth 151 which extend out of the through holes 1231 of the bottom plate 121 and are higher than the short comb-teeth 122. By providing the structure in which the comb-tooth bar 15 is embedded in the embedding groove 123 of the comb body 12, and the long comb teeth 151 are higher than the short comb teeth 122, it can not only prevent user from being scalded by the long comb teeth 151, but also can significantly reduce the weight of the comb body 12, making the operation more convenient, at the same time, it can maintain the density of the comb teeth, thereby achieving a better grasping and styling effect. In an advantageous structure, the heat-generating component 13 includes a heat-conducting plate 131 fixed on the bottom surface of the bottom plate 121, and a PTC heat-generating element 132 and an NTC temperature sensor fixed on the heat-conducting plate 131; the heat-conducting plate 131 restricts the comb-tooth bar 15 in the embedding groove 123 from the bottom surface; the heat-conducting plate 131 can not only conduct heat evenly to the comb body 12, but also be used to fix the comb-tooth bar 15, thereby making the structure compact and easy to install; the PTC heat-generating element 132 and is energy-saving and safe, while the NTC temperature sensor can ensure stable and controllable temperature. In an advantageous structure, the bottom plate 121 has two comb-tooth bars 15 arranged along an axial direction of the hair-straightening comb in the middle, and one or more elastic support bars 16 are arranged below the comb-tooth bar 15 such that the comb-tooth bar 15 is movable; the elastic support bar 16 makes the comb teeth located in the middle of the comb-tooth part 1 movable, thus they can better fit the scalp, thereby grabbing the roots of the hair, achieving a better styling effect, and increasing the comfort during use. In an advantageous structure, the comb-tooth surface of the comb-tooth part 1 is a concave arc surface, the concave arc surface enables the entire comb-tooth surface of the comb-tooth part 1 to better fit the surface of the scalp and achieve a better hair-grasping effect.

The handle part 2 includes an outer casing 21 forming a handle, a fan component 22 and a control circuit board 23 arranged in the outer casing 21, an air inlet 24 formed at the end of the outer casing 21, and control buttons 25 provided on the outer casing 21 corresponding to the position of the control circuit board 23. The fan component 22 includes a motor 221 and blades 222 driven by the motor 221, which are mounted in the outer casing 21 along the axial direction. The control circuit board 23 and the control buttons 25 are arranged on the handle part 2, thereby being compact in structure and more convenient to operate.

An air duct 18 communicating with the outer casing 21 is arranged between the housing 11 and the comb body 12, in addition, air outlet holes 17 communicating with the air duct 18 and facing the comb teeth are provided on the two sides of the housing 11. The air outlet holes 17 are provided on the edges of both sides of the housing 11, and the hair can be quickly cooled and styled by cold air after being heated and deformed by the comb body 12, thereby shortening the hair-straightening operation time. In an advantageous structure, splitter plates 141 are vertically arranged on the two sides of the heat insulation plate 14, the splitter plates 141 and the inner wall of the housing 11 form the air duct 18 communicating with the air outlet hole 17; the cold air is fed in from the outer casing 21 and blown out from the air outlet holes 17 through the air ducts 18 on both sides, thereby the air being concentrated and the cooling effect being better. In an advantageous structure, the air outlet holes 17 are inclined toward the two outer sides of the comb-tooth part 1. The air outlet holes 17 are inclined toward the outside, thereby preventing the cold air from approaching the comb body 12 and affecting the cooling effect of the cold air and the heating effect of the comb body 12.

The above description does not impose any limitation on the technical scope of the present disclosure, any amendment, equivalent change, and modification of the above embodiments based on the technical essence of the present disclosure still falls within the scope of the technical solution of the present disclosure.

Chinese Application No. 202121648316.3, filed Jul. 19, 2021, to which this application claims priority, is hereby incorporated herein by reference in its entirety.

Aspects and features of the various embodiments described above can be combined to provide further embodiments. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A hair-straightening comb for quick styling, comprising a comb-tooth part and a handle part, wherein the comb-tooth part comprises a housing with an inner cavity, a heat-conducting comb body sealingly embedded in the inner cavity, and a heat-generating component fixed on a back side of the comb body; wherein the comb body comprises a bottom plate and short comb teeth formed on an outer surface of the bottom plate, and the bottom plate has a plurality of embedding grooves distributed at intervals, a comb-tooth bar is embedded in the embedding groove, and the comb-tooth bar has long comb teeth protruding from the bottom plate and higher than the short comb teeth; the handle part comprises an outer casing, a fan component, and an air inlet provided on the outer casing, an air duct communicating with the outer casing is formed between the housing and the comb body, and two side edges of the housing are provided with air outlet holes communicating with the air duct and facing the comb teeth.

2. The hair-straightening comb for quick styling of claim 1, wherein one or more comb-tooth bars are arranged in a middle of the bottom plate along an axial direction of the hair-straightening comb, and an elastic support bar is provided below the comb-tooth bars to make the comb-tooth bars movable.

3. The hair-straightening comb for quick styling of claim 2, wherein the heat-generating component comprises a heat-conducting plate fixed on a bottom surface of the bottom plate, and a PTC heat-generating element and an NTC temperature sensor fixed on the heat-conducting plate, wherein the heat-conducting plate is configured to restrict the comb-tooth bar in the embedding groove from the bottom surface.

4. The hair-straightening comb for quick styling of claim 1, wherein the air outlet holes are inclined toward both outer sides of the comb-tooth part.

5. The hair-straightening comb for quick styling of claim 1, wherein a heat insulation plate is arranged between the housing and the comb body.

6. The hair-straightening comb for quick styling of claim 5, wherein splitter plates are vertically arranged on two side edges of the heat insulation plate, and the splitter plates and an inner wall of the housing form the air duct communicating with the air outlet holes.

7. The hair-straightening comb for quick styling of claim 1, wherein a comb-tooth surface of the comb-tooth part is a concave arc surface.

8. The hair-straightening comb for quick styling of claim 1, wherein a control circuit board is arranged in the outer casing of the handle part, and corresponding control buttons are arranged on the outer casing.

* * * * *